US005383273A

United States Patent [19]

Muller et al.

[11] Patent Number: 5,383,273

[45] Date of Patent: Jan. 24, 1995

[54] SHAVING APPARATUS HAVING A SHAVING-HEAD FRAME AND A FOIL FRAME TO BE SECURED THERETO

[75] Inventors: Ingo Muller; Ernst Poganitsch, both of Klagenfurt; Gilbert Röttig, Strau, all of Austria

[73] Assignee: U.S. Philips Corporation, New York, N.Y.

[21] Appl. No.: 92,342

[22] Filed: Jul. 15, 1993

[30] Foreign Application Priority Data

Jul. 24, 1992 [AT] Austria ..... 1516/92

[51] Int. Cl.[6] ..... B26B 19/00

[52] U.S. Cl. ..... 30/43.92; 30/43

[58] Field of Search ..... 30/43, 43.9, 43.91, 30/43.92, 34.05

[56] References Cited

U.S. PATENT DOCUMENTS

| | | | |
|---|---|---|---|
| 4,170,060 | 10/1979 | Seidel et al. | 30/43.92 |
| 4,510,687 | 4/1985 | Groothuis et al. . | |
| 4,621,423 | 11/1986 | Schemmann et al. . | |
| 4,707,916 | 11/1987 | Kness et al. . | |
| 4,891,880 | 1/1990 | Poganitsch et al. | 30/43.92 |
| 4,928,389 | 5/1990 | Melwisch et al. . | |
| 4,993,152 | 2/1991 | Deubler . | |
| 5,017,460 | 5/1991 | Schuurman . | |
| 5,058,270 | 10/1991 | Deubler et al. | 30/43.92 |
| 5,081,767 | 1/1992 | Wijma . | |
| 5,163,227 | 11/1992 | Wolf et al. | 30/43.92 |

FOREIGN PATENT DOCUMENTS

| | | |
|---|---|---|
| 0161508 | 4/1988 | European Pat. Off. . |
| 0480499 | 4/1992 | European Pat. Off. . |
| 2405462 | 8/1974 | Germany . |
| 3302610 | 8/1984 | Germany . |
| 3833179 | 4/1990 | Germany . |

*Primary Examiner*—Eugenia Jones
*Assistant Examiner*—Hwei-Siu Payer
*Attorney, Agent, or Firm*—Ernestine C. Bartlett

[57] ABSTRACT

In a shaving apparatus (1) comprising a housing (2) and a shaving head (10) with a shaving-head frame (12) and a foil frame (31) which can be locked thereto the two transverse side walls (15, 16) of the shaving-head frame (12) are extended relative to the two transverse side walls (35, 36) of the foil frame (31) in a direction towards the housing (2) of the shaving apparatus (1) by a wall extension (61, 62), and on each wall extension (61, 62) a latch (65, 66), which extends substantially in the direction of the wall extension (61, 62), is supported so as to be movable transversely of the wall extension (61, 62) against spring force to provide positive locking of the foil frame (31) in the shaving-head frame (12).

3 Claims, 4 Drawing Sheets

SHAVING APPARATUS HAVING A SHAVING-HEAD FRAME AND A FOIL FRAME TO BE SECURED THERETO

BACKGROUND OF THE INVENTION

The invention relates to a shaving apparatus comprising a housing and a shaving head adapted to be placed onto and to be secured to said housing, which shaving head comprises a shaving-head frame having two longitudinal side walls and two transverse side walls and a foil frame likewise having two longitudinal side walls and two transverse side walls and adapted to hold a foil cutter of the shaving apparatus and to be mounted and locked in the shaving-head frame through a shaving-head frame opening facing the housing, and positive locking devices acting between the shaving-head frame and the foil frame for positively locking the foil frame mounted in the shaving-head frame.

A shaving apparatus of the type defined in the opening paragraph is known, for example, from DE 24 05 462 A. In the known shaving apparatus the foil frame comprises two mounting strips which project laterally from its longitudinal side walls and which engage mounting slots in the longitudinal side walls of the shaving-head frame when the foil frame is mounted in the shaving-head frame, the mounting strips and the mounting slots interlocking to guarantee a positive connection between the foil frame and the shaving-head frame. When the foil frame is fitted into the shaving-head frame the longitudinal side walls of the foil frame should be pressed towards one another to enable the mounting strips to be inserted into the mounting slots so that the distance between the free ends of the mounting strips becomes smaller than the distance between the longitudinal side walls of the shaving-head frame. This results in a comparatively strong mechanical load being exerted on the foil frame, owing to which the foil frame may be damaged or the foil may be damaged by the foil frame. Moreover, this requires a comparatively flexible construction of the foil frame in order to allow adequate bending of the longitudinal side walls. However, this is unfavorable and undesirable. Moreover, this renders the operation of inserting the foil frame into the shaving-head frame of this known shaving apparatus comparatively intricate and unpractical. In addition, it renders removal of the foil frame from the shaving-head frame of this known shaving apparatus, for example for the purpose of cleaning or replacement, comparatively intricate and laborious, which is also considered to be undesirable and inconvenient for the user of this shaving.

SUMMARY OF THE INVENTION

It is an object of the invention to mitigate the problems encountered with a known shaving apparatus of the type defined in the opening paragraph and to provide a shaving apparatus whose foil frame can be mounted into as well as removed from the shaving-head frame in a particularly simple manner. For this purpose the invention is characterized in that the two transverse side walls of the shaving-head frame are extended relative to the two transverse side walls of the foil frame in a direction towards the housing of the shaving apparatus by a wall extension, and the inner side of the wall extension of the shaving-head frame carries, as a positive locking device, a latch supported on the wall extension, extending substantially in the direction of the wall extension towards the foil frame, and movable transversely of the wall extension against spring force, the free end of said latch being capable of positively locking the foil frame in the shaving-head frame. In this way it is achieved that the foil frame does not require any additional steps at all to interlock this frame to the shaving-head frame, so that the foil frame need not be provided with any additional projections, strips, recesses or the like to ensure positive locking, which is favourable for a simple and reliable construction. Moreover, it is thus achieved that the foil frame can be fitted into the shaving-head frame by simply passing it through the shaving-head frame opening facing the housing without deformation of the foil frame, no separate additional manipulation being required. Likewise, the foil frame can thus be removed from the shaving-head frame very simply without deformation of the foil frame because the two movable latches merely have to be moved towards the wall extensions of the two transverse side walls of the shaving-head frame, after which the foil frame can simply be taken out of the shaving-head frame. In addition, since the foil frame need not be subjected to any deformation neither when it is mounted into nor when it is removed from the shaving-head frame, it is achieved that foil frame can be of a stiff and robust construction. This has the advantage that a maximal stability of the foil frame can be obtained.

It is to be noted that from DE 38 33 179 C2 a shaving apparatus is known in which a foil frame is also secured in a shaving-head frame by means of positive locking devices. However, in this known apparatus the foil frame can be mounted in the shaving-head frame only through the shaving-head frame opening which is remote from the housing of the shaving apparatus, which is often unfavorable and undesirable, and for positively locking the foil frame in the shaving-head frame the foil frame comprises additional tabs which are integral with its longitudinal side walls and which are slightly inclined in an outward direction relative to the longitudinal side walls of the foil frame, which tabs each have a mounting opening for cooperation with mounting pins which project from the longitudinal side walls of the shaving-head frame. This shaving apparatus consequently requires special provisions on the foil frame for positively locking this frame to the shaving-head frame and, moreover, the slightly inclined tabs of the foil frame should be moved inwards by hand in order to mount the foil frame in the shaving-head frame, so that the foil frame can only be mounted in the shaving-head frame rather ineffectively, which is a disadvantage in comparison with a construction in accordance with the invention.

Moreover, it is to be noted that from EP 0,161,508 B1 a shaving apparatus is known, which also comprises a shaving-head frame and a foil frame adapted to be mounted and positively locked in this shaving-head frame but in which the foil frame can be mounted in the shaving-head frame only through the shaving-head frame opening which is remote from the housing of the shaving apparatus, which is often unfavorable and undesirable. For positively locking the foil frame in the shaving-head frame the foil frame comprises additional means, i.e. movable mounting blocks which engage behind mounting shoulders on the shaving-head frame when the foil frame is fitted into the shaving-head frame. To disengage these mounting blocks the shaving-head frame comprises two release buttons which are pivotably mounted on its transverse side walls, also constituting additional means not required with a shaving apparatus constructed in accordance with the invention.

It is to be noted also that from DE 33 02 610 C2 a shaving apparatus is known, which also comprises a shaving-head frame and a foil frame adapted to be mounted and positively locked in this shaving-head frame. For positively locking the foil frame in the shaving-head frame of this known shaving apparatus the foil frame also comprises additional means, i.e. resilient tongues arranged at the two transverse sides of the foil frame, which tongues each have either a projection or a hole for cooperation with recesses or projections provided on the shaving-head frame. In contrast, the foil frame of a shaving apparatus in accordance with the invention has the advantage that it does not require any additional steps or means at all for positively locking the foil frame in the shaving-head frame.

In a shaving apparatus in accordance with the invention the latches provided as locking devices may be formed by, for example, separate plastics parts which are each loaded by a separate spring, for example a pressure spring. However, it is found to be particularly advantageous if the latch provided as a positive locking device is formed by a blade spring. This is advantageous in view of a particularly simple, cheap and reliable construction.

It is also found to be advantageous if there is provided a spring acting between each contact portion connected to a transverse side wall of the shaving-head frame and each contact portion connected to the adjacent transverse side wall of the foil frame, which spring urges the foil frame towards the shaving-head frame opening which faces the housing and, consequently, towards the free end of the latch provided as a positive locking device. This ensures that when the latches provided as locking devices are actuated to release the foil frame the foil frame is moved over an adequate distance relative to the shaving-head frame under the influence of the force exerted by the springs acting between the foil frame and the shaving-head frame, after which an unobstructed and simple removal of the foil frame from the shaving-head frame is guaranteed.

BRIEF DESCRIPTION OF THE DRAWING

The invention will now be described in more detail with reference to the drawings, which show an exemplary embodiment to which the invention is not limited.

DETAILED DESCRIPTION OF THE INVENTION

Figure 1:
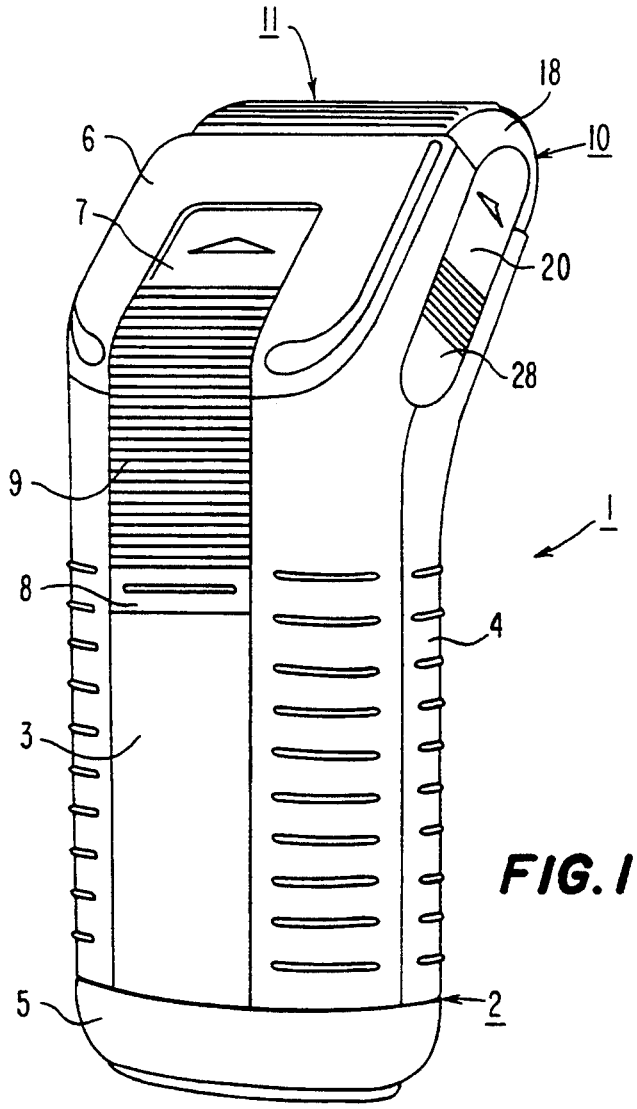

FIG. 1 is an oblique view of a shaving apparatus with a shaving head in accordance with the invention.

Figure 2:
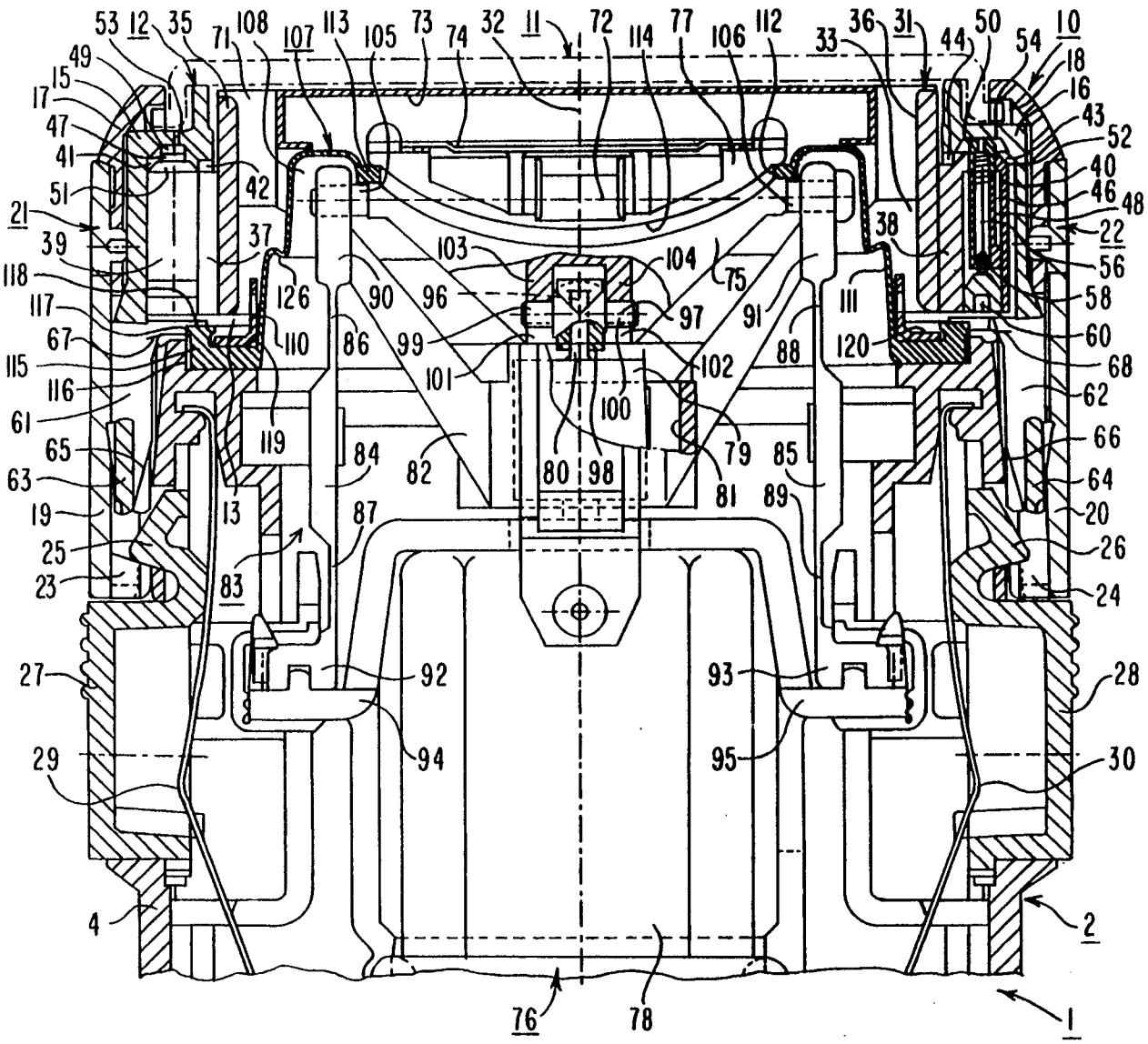

FIG. 2 is an enlarged-scale cross-sectional view showing the shaving head with a shaving-head frame and a foil frame, which is movably guided and spring-mounted relative to the shaving-head frame, and the adjacent the shaving head of the shaving apparatus shown in FIG. 1.

Figure 3:
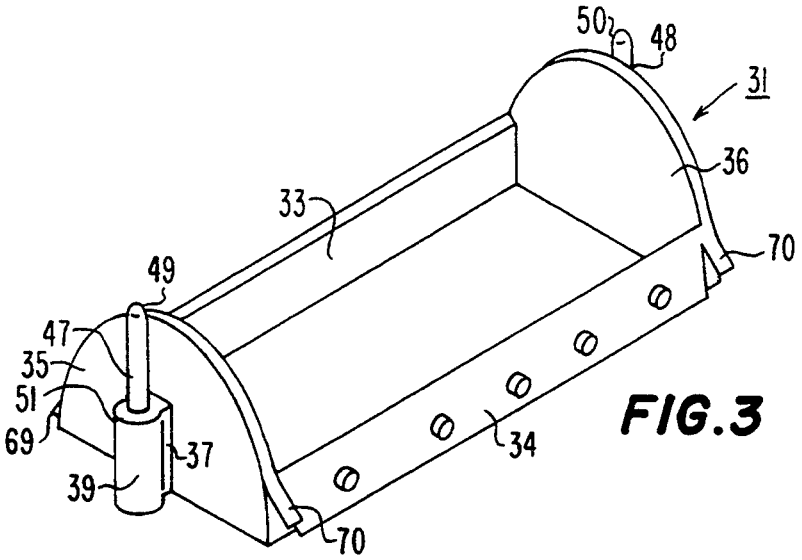

FIG. 3 is a diagrammatic oblique view of the foil frame of the shaving apparatus shown in FIGS. 1 and 2, without the foil cutter being attached to this frame.

Figure 4:
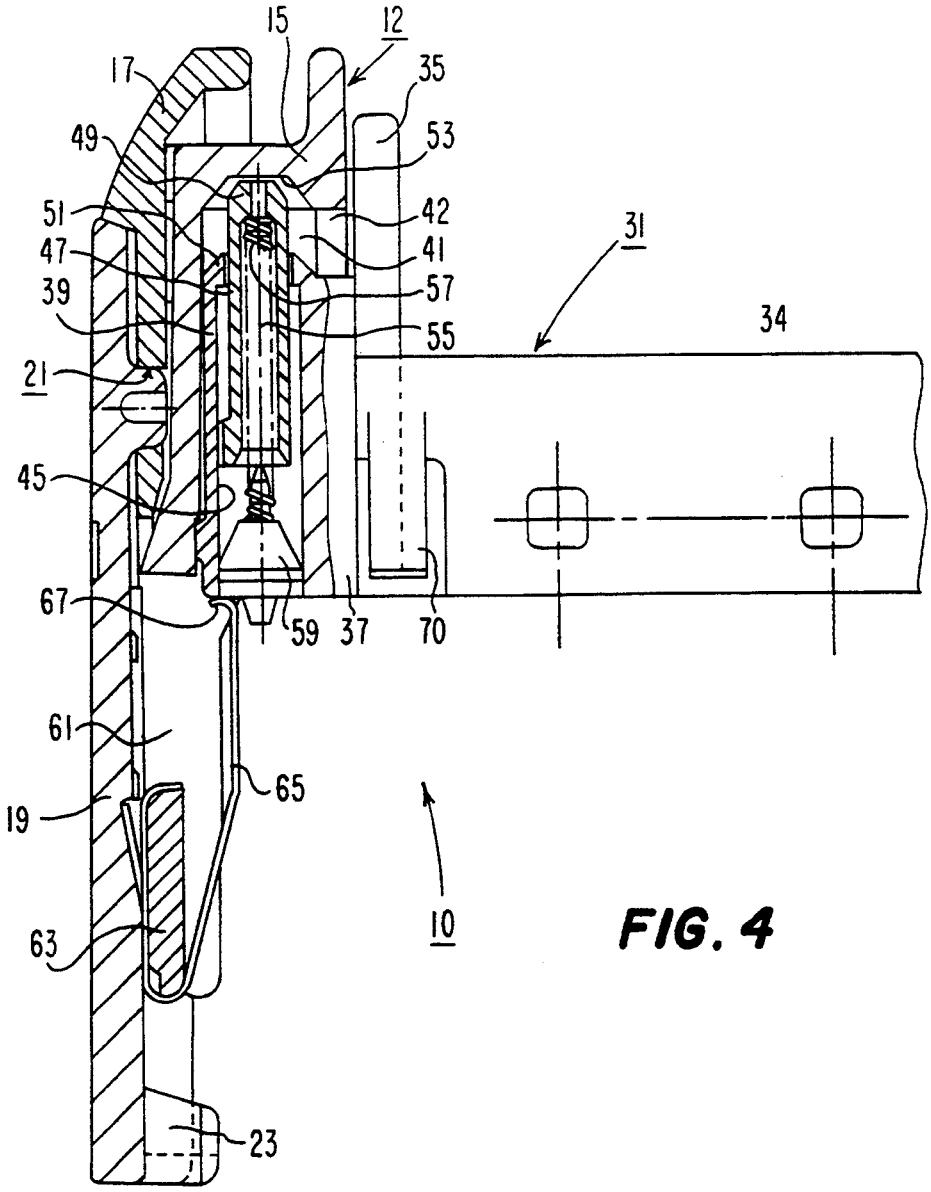

FIG. 4, in the same way as FIG. 2 but to an enlarged scale in comparison with FIG. 2, shows a part of the shaving head of the shaving apparatus shown in FIGS. 1, and 2, without the shear foil being attached to the foil frame.

FIG. 1 shows a shaving apparatus 1 having a housing 2 comprising two interconnected housing halves 3 and 4 completed by a trough-shaped housing section 5 at the bottom. A trimmer 8, not shown in FIG. 1, is arranged at the location of the housing half 3 and is movable between a rest position, in which it is retracted into the shaving apparatus 1, and an operating position, in which it is slid out of the shaving apparatus 1, said trimmer being concealed by a cover plate 6 in the rest position so that only a cutter support 7 of the trimmer is partly visible. To move the trimmer, not shown in FIG. 1, the shaving apparatus 1 has an actuating element 8, which is connected to the cutter support 7 of the trimmer by a shutter-like flexible coupling member 9.

A shaving head 10 is mounted on the housing 2 of the shaving apparatus 1 and is detachably connected to the housing 2. The shaving head 10 has a foil-like upper cutter in the form of a shear foil, which can also be covered by means of a shutter-like cover 11, which is movable substantially parallel to the main wall of the housing half 4 between a cover position shown in FIG. 1, in which it covers the foil-like upper cutter, and an open position, in which it exposes the shear foil to permit shaving.

The shaving head 10 of the shaving apparatus 1 will now be described with reference to FIGS. 2 and 4. The shaving head 10 comprises a metal shaving-head frame 12 formed by a zinc die-casting comprising a first longitudinal side wall 13, a second longitudinal side wall, not visible in the Figures, a first transverse side wall 15 and a second transverse side wall 16. A first chromium-plated plastics part 17 and 18, respectively, and a second plastics part 19 and 20, respectively, are connected to the shaving-head frame 12 at the location of the two transverse side walls 15 and 16 in the following manner: the chromium-plated plastics parts 17 and 18 are first slid onto the shaving-head frame 12 from the side which is remote from the shaving apparatus 1, after which the two other plastics parts 19 and 20, with the shaving head 10 still detached from the shaving apparatus 1, as is shown in FIG. 4, are slid onto the two chromium-plated plastics parts 17 and 18 from the side facing the shaving apparatus 1 and are each connected by means of a pin-and-socket joint 21 and 22, respectively, in that the pins engage the sockets of the pin-and-socket joints 21 and 22. The plastics parts 17, 18 and 19, 20 may be regarded as parts of the shaving-head frame 12, which consequently comprises several parts. However, alternatively it may be constructed as a single part. The two plastics parts 19 and 20 are extended with respect to the shaving-head frame 12 in a direction towards the shaving apparatus 1. At their facing inner sides the two plastics parts 19 and 20 each have a latching nose 23 and 24, respectively, which can be retained by means of a latching hook 25 and 26, respectively. In this way the shaving head 10 is fastened to the housing 2 of the shaving apparatus 1. The latching hooks 25 and 26 are arranged on push-buttons 27 and 28, respectively, which can be actuated by hand and which are movably supported in the housing 2 of the shaving apparatus 1, which push-buttons are both movable towards the interior of the apparatus against the force of blade springs 29 and 30, respectively, supported in the housing 2, in order to enable the shaving head 10 to be detached.

A foil frame 31 is mounted on the shaving-head frame 12 so as to be movable in the direction of an axis 32 perpendicular to an apex line of the foil-like upper cutter. The foil frame 31 can be fitted into and retained in the shaving-head frame 12 through the frame opening of the shaving-head frame 12, i.e. the frame side facing the housing 2. The foil frame 31, like the shaving-head frame 12, has a first longitudinal side wall 33, a second longitudinal side wall 34, a first transverse side wall 35 and a second transverse side wall 36. A cylindrical portion 39 and 40, respectively, is connected to each of the two transverse side walls 35 and 36 via a web 37 and 38, respectively. In FIG. 2 only the cylindrical portion 40 is shown in cross-section and in FIG. 3 only the cylindrical portion 39 is visible. The cylindrical portion 39 engages a hollow cylindrical guide chamber 41 in the first transverse side wall 15 of the shaving-head frame 12 with only little clearance. The guide chamber 41 adjoins a release slot 42, through which the web 37 is passed. The cylindrical portion 40 engages a guide chamber 43 of substantially rectangular cross-section in a second transverse side wall 16 of the shaving-head frame 12 with a comparatively large clearance in the direction of the longitudinal side walls 13, 14 and 33, 34 but only a small clearance in a direction transverse thereto, which chamber adjoins a release slot 44, through which the web 38 extends. In this way the cylindrical portions 39 and 40 and the guide chambers 41 and 43 guide the foil frame 31 relative to shaving-head frame 12 so as to be movable in the direction of the axis 32.

Each of the two cylindrical portions 39 and 40, as is shown for the portion 40 in FIG. 2 and for the portion 39 in FIG. 4, has a circumferentially closed hollow cylindrical duct 45, 46. Each of the ducts 45 and 46 is slidably engaged by a sleeve 47 and 48, respectively, forming a piston-like pressure member. With its substantially closed end 49, 50 each of the sleeves 47 and 48 extends from the respective duct 45 or 46 through a hole formed in the upper area 51 or 52 of the respective portion 39 or 40 and abuts against an upper bounding wall 53, 54 of the respective guide chamber 41 or 43. In each of the hollow cylindrical bores 55 and 56 of the respective sleeves 47 and 48 a helical pressure spring 57, 58 extends to the bottom of the respective bore 55 or 56. The end of each helical pressure spring 57 or 58 which is remote from the sleeve bottom acts against a closing member 59 or 60, which is formed by an insert pressed into the respective duct 45 or 46 to close this duct 45 or 46. In this way the two helical pressure springs 57 and 58 provide a spring load between the foil frame 31 and the shaving-head frame 12. As a result, the helical pressure springs 57 and 58 tend to move the foil frame 31 relative to the shaving-head frame 12, which is fixed to the housing 2 of the shaving apparatus 1 by the latching hooks 25 and 26, towards the shaving apparatus 1 parallel to the axis 32. This has the advantage that in the ducts 45 and 46 the helical pressure springs 57 and 58 are captively retained and protected against contamination and the helical pressure springs 57 and 58 act on the shaving-head frame 12 via the sleeves 47 and 48, the cylindrical portions 39 and 40 with the inserts 59 and 60 and the upper bounding walls 53 and 54 forming contact portions for the helical pressure springs 57 and 58 on the foil frame 31 and the shaving-head frame 12.

In order to limit the possibility of movement of the foil frame 31 relative to the shaving-head frame 12, i.e. in order to hold the foil frame 31 in the shaving-head frame 12 when this frame 12 is removed from the shaving apparatus 1 and prevent it from falling out, the present shaving apparatus 1 has the following very simple and advantageous provisions. The two transverse side walls 15 and 16 of the shaving-head frame 12 are extended relative to the two transverse side walls 35 and 36 of the foil frame 31 in the direction of the housing 2 of the shaving apparatus 1 and each has a wall extension 61 and 62, respectively, which wall extensions project from the shaving-head frame 12 towards the shaving apparatus 1 and are covered by the plastics pans 19 and 20. These wall extensions 61 and 62 are legs of substantially U-shaped bridge portions 63 and 64, respectively, Blade springs 65 and 66, which extend substantially in the direction of the wall extension 61 or 62, respectively, towards the foil frame 31, are connected to the two bridge portions 63 and 64, respectively and act as positive locking devices. The two blade springs 65 and 66 serve as movable latches with whose respective free ends 67 and 68 the foil frame 31 can be locked positively in the shaving-head frame 12 in that the free ends 67 and 68 of the blade springs 65 and 66, respectively, bear against the cylindrical portions 39 and 40, respectively, and the respective closing members 59 and 60 at this location and thus take up the forces exerted by the helical pressure springs. In this way the foil frame 31 is reliably secured in the shaving-head frame 12 by simple means, the construction of the latching devices as blade springs 65 and 66 further having the advantage of allowing a very simple mounting and removal of the foil frame 31 into and from the shaving-head frame 12. To mount the foil frame 31 it is simply inserted between the two blade springs 65 and 66, which serve as latches and which then deflect, and it is then also ensured advantageously that the sleeves 47 and 48 cooperate with the bounding walls 53 and 54 provided for this purpose. To remove the foil frame 31 the blade springs 65 and 66 are simply pressed apart by hand, after which the foil frame 31 is initially pressed out of the shaving-head frame 12 under the influence of the helical pressure springs 57 and 58 and can subsequently be pulled freely out of the shaving-head frame 12. The foil frame 31 is positively locked in the shaving-head frame 12 by means of the blade springs 65 and 66 only in a direction parallel to the axis 32, the blade springs 65 and 66 providing no positive locking of the foil frame in a direction transverse to the axis 32.

At its four comers the foil frame 31 has resilient tabs 69 and 70 projecting obliquely from the respective longitudinal side walls 33 and 34. These tabs 69 and 70 are integral with the foil frame 31. The tabs 69 and 70 bear against the longitudinal side walls 13 and 14 of the shaving-head frame 12, so that the clearance between the guide chambers 41 and 43 of the shaving-head frame 12 and the cylindrical portions 39 and 40 of the foil frame 31 in a direction transverse to the longitudinal side walls 13, 14 and 33, 34 is compensated for and cannot give rise to noise.

The foil frame 31 serves to hold the afore-mentioned foil-like upper cutter of the shaving head 10, which in the present case is formed by a shear foil 71 which, in a manner not shown, has two longitudinal edge portions attached to the two longitudinal side walls 33 and 34 of the foil frame 31. The shear foil 71 then assumes an arched shape relative to an axis 72 perpendicular to the axis 32, so that its area formed with hair-entry apertures constitutes a shaving area which is arched relative to the axis 72.

The shear foil 71 cooperates with a lower cutter 73, which in the present shaving apparatus 1 is of a laminar or foil-like construction, the foil thickness of the lower cutter 73 being larger than the foil thickness of the shear foil 71. The lower cutter 73 is secured to a lower-cutter support 74, to which the longitudinal edges of the lower cutter 73 are connected in a manner, not shown. The lower cutter 73 also has an arched shape relative to the axis 72. In its central area the lower cutter also has hair-entry apertures, which central area also constitutes a shaving area which is arched relative to the axis 72.

The lower cutter support 74 together with the foil-like lower cutter 73 secured thereto is connected to a drive member 75 of a drive means 76 of the shaving apparatus 1, the lower cutter support 74 being mounted and latched onto a driving portion 77 of the drive member 75. The drive means 76 will be described briefly hereinafter. For the drive means 76 reference is made to EP 0,480,499 A1 from which a shaving apparatus 1 comprising such a drive means is known and which is herewith incorporated by reference.

The drive means 76 comprises a motor 78, whose rotatably drivable motor shaft, not shown in FIG. 2, is connected to a rotatably drivable eccentric 79 from which a pin 80 projects which is eccentric relative to the shaft of the motor 78. In the present case the eccentric 79 extends through an opening 81 in a substantially V-shaped coupling portion 82 of a reciprocating bridge 83. In addition to the V-shaped coupling portion 82 the reciprocating bridge comprises two limbs 84 and 85, which each have two integral-hinge portions 86, 87 and 88, 89, respectively, and which are each connected to the V-shaped coupling portion 82 by a connecting portion 90 and 91, respectively, adjoining the integral-hinge portions 86 and 88, respectively, and which are secured to a stationary mounting portion 94 and 95, respectively, of the apparatus by a fixing portion 92 and 93, respectively, connected to the other integral-hinge portions 87 and 89, respectively.

The eccentric pin 80 of the eccentric 79 projects into a bore 96 in a transmission member 98 having a cylindrical shape relative to an axis 97 parallel to the axis 72 from which two cylindrical projections 99 and 100 project laterally, which projections are coaxial with the axis 97. These projections 99 and 100 engage two slots 101 and 102 which are open towards the eccentric 79 and which have two tabs 103 and 104 projecting from the drive member 75. The drive member 75, which can be driven by the eccentric pin 80 via the transmission member 98, has two cylindrical later projections 105 and 106 which are coaxial with the axis 72 and which are rotatable or pivotable in two slots in the connecting portions 90 and 91, which slots are open towards the lower cutter 73.

The limbs 84 and 85 of the reciprocating bridge 83 are stiff in the direction of the axis 32, so that the drive member 75, which is pivotably supported in the connecting portions 90 and 91 and the lower cutter 73 connected to the drive member 75 via the lower cutter support 74 can perform no or only a negligibly small movement in the direction of the axis 32. However, the limbs 84 and 85 are highly flexible in the direction of the axis 72, allowing the lower cutter 73 to perform a reciprocating oscillatory movement parallel to the axis 72. In the present shaving apparatus 1, in addition to this reciprocating movement of the lower cutter 73, a swinging movement about the axis 72 is imparted to the lower cutter 73 via the drive means 76 described above, which swinging movement is superposed on the reciprocating movement parallel to the .axis 72, so that in the present shaving apparatus 1 the lower cutter 73 performs a combined movement consisting of a linear reciprocating movement and a swinging movement.

Thus, in the present shaving apparatus 1 the lower cutter 73 is supported stiffly in the direction of the axis 32. The shear foil 71 is pressed against the lower cutter 73 thus supported in that the shear foil 71, which is secured to the foil frame 31, is loaded by the helical pressure springs 57 and 58, which bear against the shaving-head frame 12 via the sleeves 47 and 48. In this way, the shear foil 71 in the present shaving apparatus 1 is spring-loaded relative to the lower cutter 73, which is also of a substantially foil-like construction. This spring load ensures that the shear foil 71 and the foil-like lower cutter always interengage correctly, which guarantees a satisfactory shaving performance and shaving quality, the shaving performance of the shaving apparatus 1 being very high owing to the combined movement of the lower cutter 73.

In order to preclude the ingress of shaving particles at the location of the drive means 76 in the shaving apparatus 1 the shaving apparatus 1 has a dust seal 107. The dust seal 107 is made of an elastic material, i.e. of rubber. The dust seal has hoodlike and trough-like shape and is arranged around the block-shaped drive member 75. The dust seal 107 has four side walls of which the side walls 108, 110 and 111 are shown in FIG. 2. The side walls 110 and 111 are shorter than the other two side walls, 108 and the fourth side wall which is not shown. The dust seal 107 further has an end portion 113 connecting the dust seal 107 to the drive member 75, which end portion bounds the four side walls at their ends facing the lower cutter 73 and which has an opening 112 for the passage of the driving portion 77 of the drive member 75. For this purpose the drive member 75 has a continuous circumferential groove 114 in which the dust seal 107 engages with its wall portions bounding the opening 112 in the end portion 113. The dust seal 107 further has a peripheral portion 115 with which the dust seal 107 engages against a stationary zone of the housing, which peripheral portion bounds the four side walls of the dust seal 107 at their ends which are remote from the lower cutter 73.

As is shown in FIG. 2, the peripheral portion 115 of the dust seal 107 engages a step 116 which is formed inside the housing and which is open towards the shaving head 10. Moreover, the dimension of the peripheral portion 115 in the height direction of the step 116 is selected in such a manner that the peripheral portion 115 of the dust seal 107 presses against an area 118 of the shaving head 10 or its shaving-head frame 12 with a peripheral zone 117 which is free from the step 116. This prevents mechanical vibrations between the housing 2 of the shaving apparatus 1 and the shaving head 10 and its shaving-head frame 12, so that such vibrations cannot give rise to noise and a silently operating shaving apparatus is obtained. The dust seal 107 is secured in the shaving apparatus 1 by means of two resilient clips 119 and 120. The resilient clips 119 and 120 are passed through recesses at the comers of the peripheral portion 115 of the dust seal 107 and are clamped to ridges on the housing with their bent end portions.

As can be seen in FIG. 2, the dust seal 107 has a shoulder 126 which extends over all four side walls of the dust seal 107. In the present shaving apparatus 1 this shoulder 126 has an undulating shape at the two facing side walls which extend parallel to the direction of the axis 72. The undulating portions of the shoulder 126 are sawtooth-shaped. However, the undulating portion may also have a substantially sinusoidal shape. If desired, the shoulder 126 may also have an undulating shape at the two shorter side walls 110 and 111. The provision of the shoulder 126 with an undulating shape ensures that the wall portions of the larger side walls which are separated from each other by the shoulder 126 with an undulating shape can perform almost only movements parallel to these larger wall portions, so that these side walls of the dust seal 107 do not act as an acoustic diaphragm. Thus, it is achieved that the dust seal 107 produces only very little noise, which is also advantageous in order to realize a very silent shaving apparatus with such a dust seal.

The invention is not limited to the exemplary embodiment described hereinbefore. The invention can also be employed in a shaving apparatus in which the lower cutter does not perform a combined reciprocating movement and swinging movement but merely a pure reciprocating movement. Moreover, other constructions are possible as regards the latches provided as positive locking devices. Such latches may be constructed, for example, as pivotable levers which are each loaded by a separate spring.

We claim:

1. A shaving apparatus (1) comprising a housing (2) and a shaving head (10) adapted to be placed onto and to be secured to said housing (2), which shaving head comprises a shaving-head frame (12) having two longitudinal side walls (13, 14) and two transverse side walls (15, 16) and a foil frame (31) likewise having two longitudinal side walls (33, 34) and two transverse side walls (35, 36) and adapted to hold a foil cutter (71) of the shaving apparatus (1) and to be mounted and locked in the shaving-head frame (12) through a shaving-head frame (12) opening facing the housing (2), and positive locking devices (65, 66) acting between the shaving-head frame (12) and the foil frame (31) for positively locking the foil frame (31) mounted in the shaving-head frame (12), characterized in that the two transverse side walls (15, 16) of the shaving-head frame (12) are extended relative to the two transverse side walls (35, 36) of the foil frame (31) in a direction towards the housing (2) of the shaving apparatus (1) by a wall extensions (61, 62), and the inner side of the wall extensions (61, 62) of the shaving-head frame (12) carries said positive locking devices (65, 66) and each of said positive locking devices being a latch supported on a respective one of the wall extensions (61, 62), said latch extending substantially in the direction of its respective wall extension (61, 62) towards the foil frame (31), and movable transversely of its respective wall extension (61, 62) against spring force, said latch having a free end (67, 68) capable of positively locking the foil frame (31) in the shaving-head frame (12).

2. A shaving apparatus as claimed in claim 1, wherein said the latch (65, 66) is formed by a blade spring.

3. A shaving apparatus as claimed in claim 1, further comprising of a spring (57, 58) acting between each contact portion (53, 54) connected to a transverse side wall (15, 16) of the shaving-head frame (12) and each contact portion (39, 40) connected to the adjacent transverse side wall (35, 36) of the foil frame (31), which spring urges the foil frame (31) towards the shaving-head frame (12) opening which faces the housing (2) and, consequently, towards the free end (67, 68) of the latch (65, 66). Shaving apparatus having a shaving-head frame and a foil frame to be secured thereto.

* * * * *